US006941952B1

(12) United States Patent
Rush, III

(10) Patent No.: US 6,941,952 B1
(45) Date of Patent: Sep. 13, 2005

(54) ATHLETIC MOUTHPIECE CAPABLE OF SENSING LINEAR AND ROTATIONAL FORCES AND PROTECTIVE HEADGEAR FOR USE WITH THE SAME

(76) Inventor: Gus A. Rush, III, 1800 12th St., Meridian, MS (US) 39301

( * ) Notice: Subject to any disclaimer, the term of this patent is extended or adjusted under 35 U.S.C. 154(b) by 0 days.

(21) Appl. No.: 11/000,917

(22) Filed: Dec. 2, 2004

(51) Int. Cl.[7] ..... A61C 5/14

(52) U.S. Cl. ..... 128/861; 128/845; 128/857; 433/6; 2/5; 2/6.1; 2/6.6; 2/205; 2/909

(58) Field of Search ..... 128/861, 862, 128/859, 848, 845, 857; 602/902; 604/77; 29/896.1, 896.11; 433/6, 48, 37; 2/5, 6.1, 2/6.6, 421, 205, 909

(56) References Cited

U.S. PATENT DOCUMENTS

| | | | | |
|---|---|---|---|---|
| 3,682,164 | A * | 8/1972 | Miller | 128/857 |
| 3,848,335 | A * | 11/1974 | Bergersen | 433/6 |
| 4,198,990 | A | 4/1980 | Higgins et al. | |
| 4,461,553 | A | 7/1984 | Doerr et al. | |
| 4,672,959 | A * | 6/1987 | May et al. | 128/861 |
| 4,817,633 | A | 4/1989 | McStravick et al. | |
| 4,979,516 | A * | 12/1990 | Abraham, II | 128/862 |
| 5,078,153 | A | 1/1992 | Nordlander et al. | |
| 5,245,592 | A * | 9/1993 | Kuemmel et al. | 433/6 |
| 5,539,935 | A | 7/1996 | Rush, III | |
| 5,621,922 | A | 4/1997 | Rush, III | |
| 5,682,904 | A * | 11/1997 | Stinnett | 128/861 |
| 5,978,972 | A | 11/1999 | Stewart et al. | |
| 6,048,324 | A | 4/2000 | Socci et al. | |
| 6,121,881 | A | 9/2000 | Bieback et al. | |
| 6,231,337 | B1 * | 5/2001 | Boyd | 433/6 |
| 6,295,988 | B1 * | 10/2001 | Sue | 128/859 |
| 6,299,441 | B1 * | 10/2001 | Novak | 128/861 |
| 2002/0062069 | A1 | 5/2002 | Mault | |
| 2002/0107433 | A1 | 8/2002 | Mault | |
| 2003/0154990 | A1 | 8/2003 | Parker | |

* cited by examiner

*Primary Examiner*—Fadi H. Dahbour
(74) *Attorney, Agent, or Firm*—Pillsbury Winthrop Shaw Pittman LLP

(57) ABSTRACT

A mouthpiece assembly for use in detecting impact forces on the neck and head of a user is disclosed. The mouthpiece assembly includes sensors which determine linear and rotational impact forces on the user. The mouthpiece assembly includes a mouth guard having a channel sized to receive the upper teeth therein. A raised dome portion extends from the mouth guard and is adapted to be positioned adjacent the roof of the mouth. The sensors are located in the raised dome portion and the mouth guard or in other locations of the mouthpiece if mouthpiece sensors are required. An indicator is provided to provide a visual and/or audible indication when the magnitude of an impact exceeds a threshold value.

26 Claims, 7 Drawing Sheets

ATHLETIC MOUTHPIECE CAPABLE OF SENSING LINEAR AND ROTATIONAL FORCES AND PROTECTIVE HEADGEAR FOR USE WITH THE SAME

BACKGROUND OF THE INVENTION

1. Field of the Invention

The present invention relates to a mouthpiece for use by an athlete while participating in contact sports (e.g., football, hockey, lacrosse), which is used in combination with a protective helmet or protective headgear. In particular, the present invention relates to a mouth piece having at least one sensor located therein to sense and measure linear and rotational forces on the head of a contact sports participant.

2. Description of Related Art

Participation in athletic activities is increasing at all age levels. All participants may be potentially exposed to physical harm as a result such participation. Physical harm is more likely to occur in athletic events were collisions between participants frequently occurs (e.g., football, field hockey, lacrosse, ice hockey, soccer and the like). In connection with sports such as football, hockey and lacrosse where deliberate collisions between participants, the potential for physical harm and/or injury is greatly enhanced. Mouth guards are coverings worn over the teeth to protect teeth from injury during participation in sports. The use of mouth guards is well known. Additionally, the use of helmets in a variety of different sporting events are well known. The primary purpose of these helmets is to protect a wearer's head from injury in the event that a force is directed thereat. These helmets typically have a hard outer shell that covers an energy-absorbing material. The hard outer shell of most sport helmets is typically comprised of a plastic material. The outer shell typically covers an expanded inner layer that lies between the outer shell and the wearer's head. The inner layer is intended to absorb energy in the event it becomes necessary in order to minimize the energy transmitted to a wearer's head.

At the school level, school authorities have become sensitive to the risk of injury to which student participants are exposed, as well as to the liability of the school system when injury results. Greater emphasis is being placed on proper training and instruction to limit potential injuries. Some players engage in reckless behavior on the athletic field or do not appreciate the dangers to which they and others are subject by certain types of impacts experienced in these athletic endeavors. Unfortunately, the use of mouth guards and helmets do not prevent all injuries. One particularly troublesome problem is when a student athlete experiences a head injury, such as a concussion, of undetermined severity even when wearing protective headgear. In general, it is difficult to quickly determine the severity of the concussion so as to enable a coach, game official, or even a medical doctor to determine whether the student can continue play. The same problem arises in the professional sports leagues where the stakes are much higher for a team, where such a team loses a valuable player due to the possibility of a severe head injury. Recent medical data suggest that lateral and rotational forces applied to the head and neck area (for example, flexion/extension, lateral flexion, and axial rotation) are more responsible for axonal nerve damage than previously thought. Previous medical research had indicated that axially directed forces (such as spinal compression forces) were primarily responsible for such injuries.

It is desirable to measure the impacts to the skull and brain in order to design safer helmets and helmet liners. It is also desirable to measure the impacts to the skull and brain while the player is participating in the sporting activity. The inventor of the subject matter of the present invention holds numerous patents relating to helmet safety including U.S. Pat. No. 5,539,935, entitled "Sports Helmet," issued on Jul. 30, 1996 and U.S. Pat. No. 5,621,922, entitled "Sports Helmet Capable of Sensing Linear and Rotational Forces," issued on Apr. 22, 1997. The disclosures of both of these patents are incorporated specifically herein by reference. Both patents relate to impact sensors for linear and rotational forces in a football helmet. These devices work well testing the impact to the skull of a player. If an athlete suffers a concussion, for example, it will be possible to determine if the relative magnitude of an impact is dangerously high relative to the threshold to which each sensing device is adjusted, taking into consideration the size and weight of the player. Thus, when one of the sensing devices is activated, thereby illuminating a signaling LED or lamp in the helmet, a game official and/or a coach will be able to immediately determine that play should be stopped and that the potentially injured player should be attended to. This arrangement allows players injured only slightly to continue to play in an athletic contest while minimizing the risk of serious injury.

These developments will lead to increased player safety. These devices measure the impacts absorbed by the helmet. The devices then estimate the impact absorbed by the head and neck. There is a need to more accurately determine the actual forces absorbed by the head and neck during a collision or hit. There have been attempts to fit sensors to the skin and ear canals of players. While these devices will provide a more accurate reading of skull impact, the application is more limited to helmet design rather than actual use on the field by players.

SUMMARY OF THE INVENTION

In response to the foregoing challenges, applicant has developed an innovative sensing mouthpiece assembly for sensing impact forces on a head of a user. In accordance with an aspect of the present invention, the mouthpiece assembly includes a mouth guard. The mouth guard is shaped to receive the set of the upper teeth therein. The mouth guard includes a channel sized to receive the upper teeth therein such that the mouth guard is releasably secured to at least the rear molars of the user. In accordance with an aspect of the present invention, the mouthpiece assembly also includes a raised dome portion extending from the mouth guard. The raised dome portion is shaped to conform to at least a portion of the hard palate or bony palate of the mouth of the user. The mouthpiece assembly includes at least one linear force sensor for measuring linear forces exerted on the head and/or neck of the user during an impact event (e.g., a collision or tackle). The mouthpiece also includes at least one rotational force sensor for measuring rotational forces exerted on the head and/or neck of the user during the impact event. The rotational force sensors and the linear force sensors are preferably located on at least the raised dome portion. The sensors may also be located on the mouth guard. In accordance with an aspect of the present invention, the sensors may be accelerometers. While it may be possible to obtain the necessary measurement of impact forces with a single accelerometers, it is preferable that a plurality of accelerometers be provided in the mouthpiece assembly to accurately measure and detect the impact forces.

The mouthpiece assembly also includes at least one indicator operatively connected to the sensors. The indicator provides an indication when the forces detected by the sensors exceed a predetermined threshold. It is contemplated that the indicator can provide a visual and/or audible indication when the head and neck of the athlete absorb a force greater than threshold value, which could result in a concussion or other significant injury. The indicator permits the referees on the field and the coaching staff on the sidelines to monitor and remove players from the field to prevent players from continuing play when they a potentially injured.

In accordance with an aspect of the present invention, the mouth guard and the raised dome portion are formed from a rigid material. The rigid material may be a plastic material. In order to provide a layer of protection to the teeth enamel, it is contemplated that a soft material may be located in the channel, whereby the upper teeth contact the soft material when the set of teeth are positioned in the channel.

In accordance with another aspect of the present invention, the sensing mouthpiece may further include a connector strap extending from the mouth guard. The connector strap is adapted to secure the mouthpiece to a protective helmet. The strap may be used to either permanently secure the mouthpiece to the helmet or removably secure the mouthpiece. It is contemplated that the connector strap may be secured to the face protector of the helmet or directly to the helmet.

In accordance with one aspect of the present invention, the indicator is located on the connector strap such that it may be visible to the referees on the field and the coaches and staff on the sidelines. The indicator is electrically connected to the sensors. It is contemplated that more than one indicator can be provided. For example, a first indicator may be located on the connector strap and a second indicator may be located on an extensive of the connector strap that is positioned on the protective helmet. The indicator may also be remotely located (e.g., on a receiver on the sideline). When the indicator is remotely located, the mouthpiece includes a transmitter for transmitting signals from the sensors to a remote receiver, which includes the indicator. With such an arrangement, it may be possible to monitor multiple athletes from a single panel.

In accordance with another aspect of the present invention, the mouthpiece assembly may be combined with a protective helmet. The protective helmet may also include sensors for detecting impact forces on the head and neck of the user. The helmet may also include an indicator for indicating when a particular impact threshold has been exceeded. It is contemplated that the sensors in the protective helmet may be linked to the indicators associated with the mouthpiece.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

Figure 1:
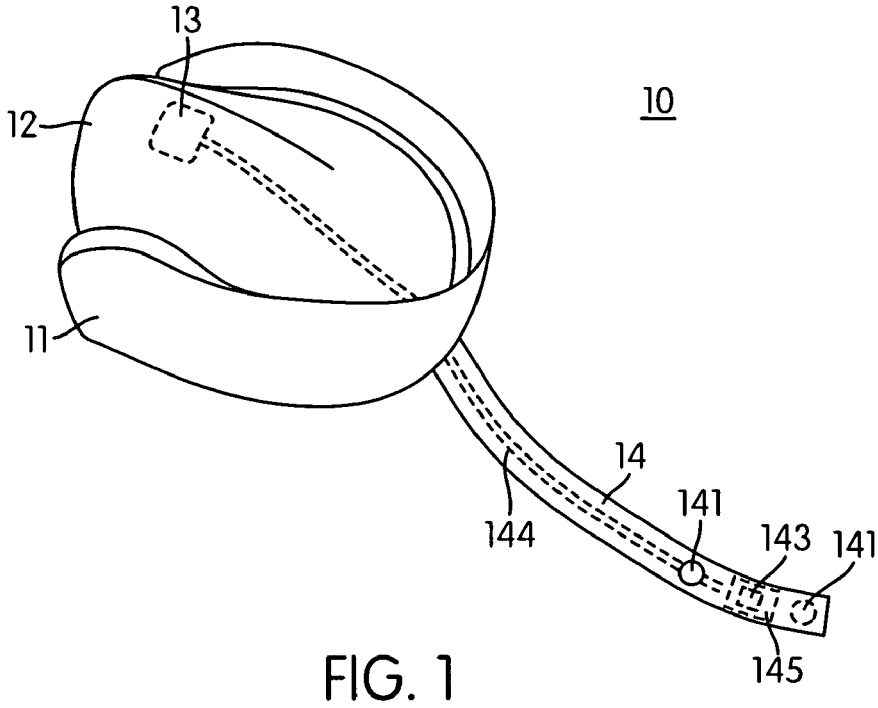
FIG. 1 is a right front side perspective view of a mouthpiece in accordance with an embodiment of the present invention.
Figure 2:
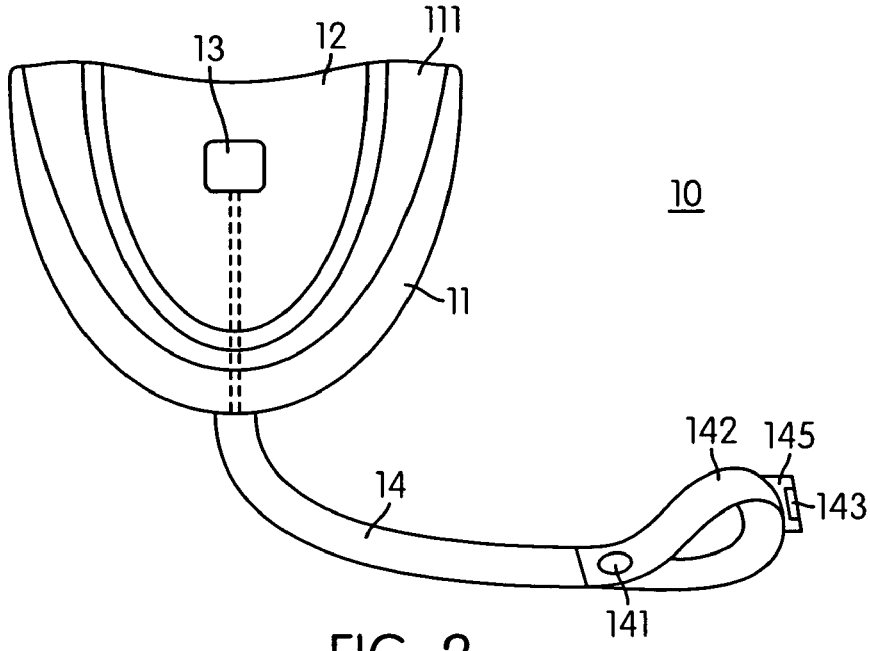
FIG. 2 is a top view of the mouthpiece of FIG. 1.

A mouthpiece assembly for sensing both linear and rotational forces in accordance with preferred embodiments of the present invention will now be described in greater detail in connection with FIGS. 1–7. By sensing linear and rotational forces, the mouthpiece assembly can determine the magnitude of a force absorbed by the head and neck of the user as a result of an impact associated with participation in contact sports. It is contemplated that the mouthpiece assembly may used in connection with the design and development of improved protective headgear whereby the mouthpiece assembly is used in a laboratory or testing environment. It is also contemplated that the mouthpiece assembly will be used in real time. Athletes will use the mouthpiece while participating in contact sports for the real time measurement of the impact that they sustain. An indicator on the mouthpiece or in the helmet or an indicator at a remote location (e.g., the sideline) will provide a visual and/or audible indication when the head and/or neck of the athlete has experienced an injurious force. The data obtained from the sensors can be stored in the helmet, transmitted to the sidelines or downloaded from the helmet on the sidelines. As such, coaches and referees can monitor the athletes to determine if and when an athlete has encountered an excessive impact which could result in a concussion or other serious injury. Based on this information, the athlete can then be removed from the game if necessary. Additionally, this real time data can be used to promote concussion research.

A mouthpiece assembly 10 according to one embodiment of the present invention will now be described in connection with FIGS. 1–4. The mouth piece assembly 10 includes a mouth guard 11. The mouth guard 11 is sized fit in the mouth such that it covers the upper set of teeth. The mouth guard 11 is preferably custom fit to the mouth of the athlete to ensure an accurate fit, which will produce more accurate force measurements. The mouth guard 11 includes a channel 111 formed therein. The channel 111 is sized to receive the upper set of teeth therein. Furthermore, the channel 111 is sized to engage the rear upper molars so that there is no movement of the mouth guard 11 with respect to the teeth during use. The mouth guard 11 is formed from a rigid plastic or other suitable material that is capable of withstanding forces generated by the athlete's teeth contacting the upper and lower surfaces of the mouth guard 111 while participating in contact sports. The interior of the channel 111 has a liner 112 formed from a softer material (e.g., silastic, silicone or the material that is durable and protective). The liner 112 of softer material prevents damage to tooth enamel.

Figure 4:
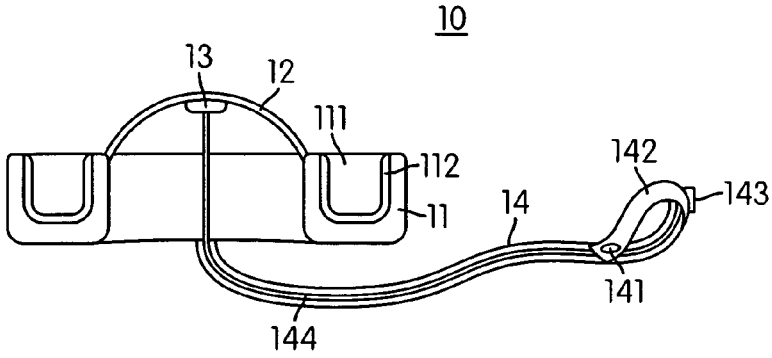
FIG. 4 is a rear end view of the mouthpiece of FIG. 1.

The mouthpiece assembly 10 includes a rigid dome 12. The rigid dome 12 extends from an upper surface of the mouth guard 11, as shown in FIGS. 1 and 4. The rigid dome 12 is adapted to be positioned adjacent the roof of the athlete's mouth or the bony palate. Like the mouth guard 11, the rigid dome 12 is custom fit to the athlete's mouth such that an upper portion of the rigid dome 12 is positioned adjacent the bony palate. The bony palate in the roof of the mouth connects directly to the palatine bone, which connects to the base of the brain in the sella turcica. The mouth guard 11 and the rigid dome 12 are preferably molded and formed as a single unit.

The mouthpiece assembly 10 includes a plurality of sensors 13. At least one sensor 13 is preferably secured to an upper portion of the rigid dome 12 in the vicinity of the athlete's bony palate. This location adjacent the bony palate in the roof of the mouth is a suitable location for measuring forces absorbed by the brain during impact. It is preferable that the sensor 13 is a miniature accelerometer, which accurately senses any impacts to the head and/or neck of the athlete. It is contemplated that more than one sensor 13 can be secured to the rigid dome 12. It is also contemplated that the one or more sensor 13 can be integrated into the mouth guard 11. The location of the sensors 13 in this region is ideal because the roots of the molar teeth are rigidly secured to the bony structure which houses the brain. When an impact to the skull occurs, it can be accurately measured. The preferred locations for sensors 13 are illustrated in FIGS. 8–11.

FIGS. 8–11 illustrate potential locations for the sensors 13. It is preferable that the mouthpiece assembly 10 include multiple sensors 13 such that both rotational and lateral forces can be measured. It is preferable that at least three sensors 131, 132, 133 be located in upper portion of the rigid dome 12 so that the sensors 131, 132, 133 are located in close proximity to the bony palate. Sensor 131 is positioned to measure forces along the z-axis. Sensor 132 is positioned to measure forces along the y-axis. Sensor 133 is positioned to measure forces along the x-axis. Together the sensors 131, 132 and 133 provide an accurate measurement of linear forces absorbed by the head and neck during impact. It is also contemplated that the sensors 131, 132 and 133 together provide a measurement of rotational forces on the athlete.

Figure 8:
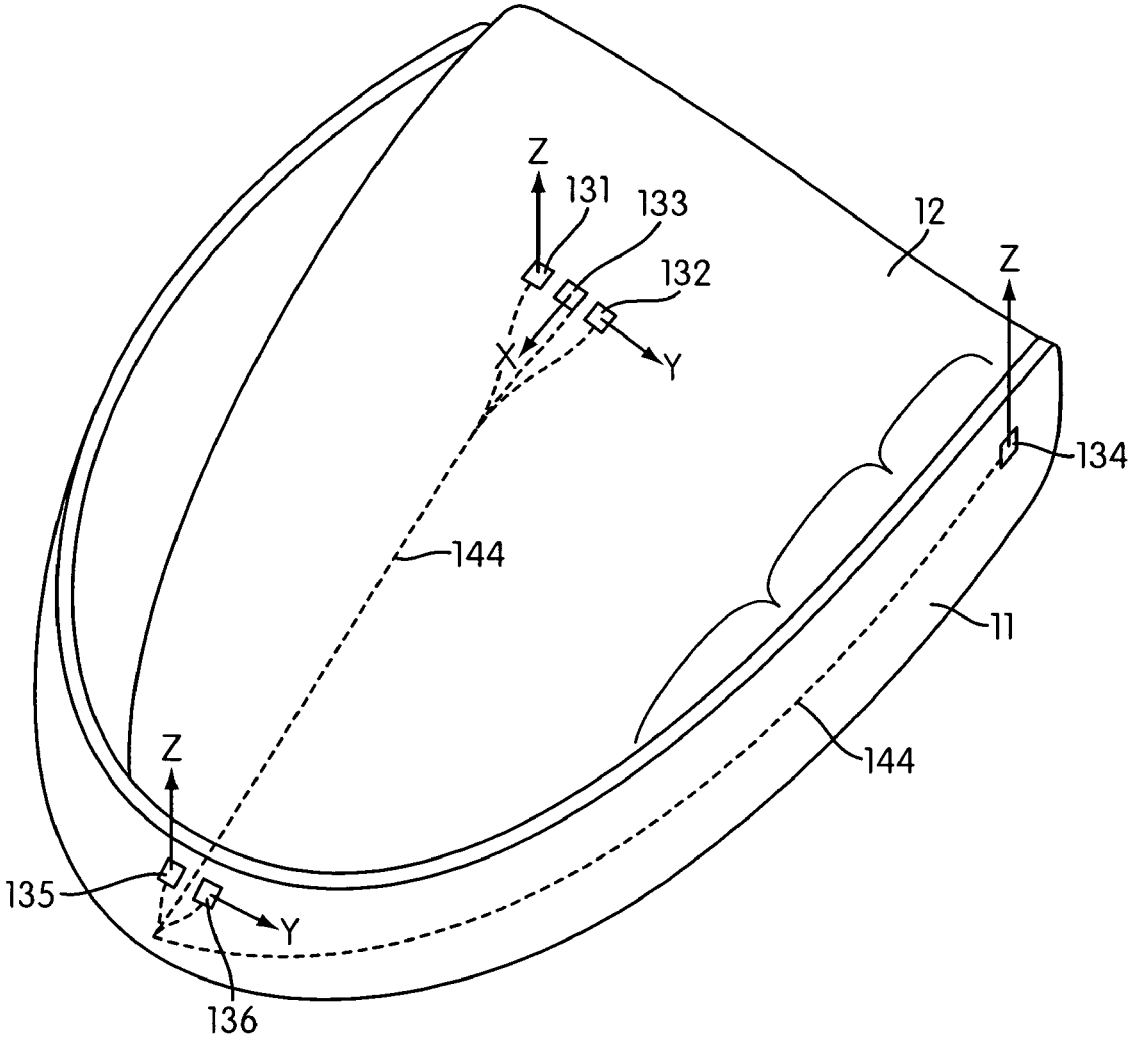
FIG. 8 is a schematic view illustrating a mouthpiece in accordance with the embodiments of the present invention having six sensors.

As shown in FIG. 8, a total of six sensors may be provided. In addition to the sensors 131, 132, 133, it is preferable that the mouthpiece assembly include at leas one sensor 13 located in the mouth guard 11. A sensor 134 may be provided in the rear portion of the mouth guard 11 to measure forces in the z-direction. The sensor 134 is positioned near the rear molars. Additional sensors 135 and 136 are located in the mouth guard 11. Sensor 135 measures forces in the z direction. Sensor 136 measures forces in the y-direction. Sensors 135 and 136 can, for example, be used to measure rotational forces by measuring angular movement.

Figure 9:
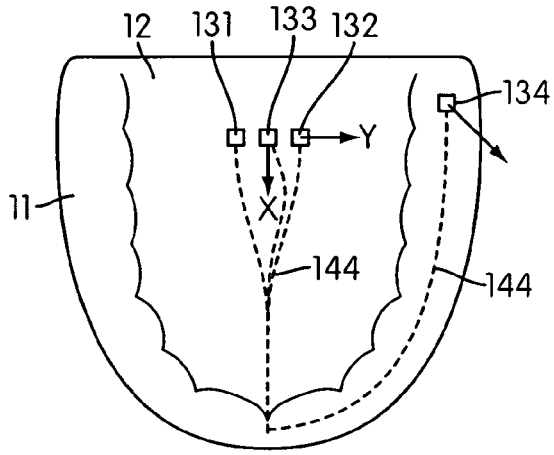
FIGS. 9, 10 and 11 are schematic top, side and front views, respectively, illustrating a mouthpiece assembly in accordance with embodiments of the present invention having nine sensors.
Figure 10:
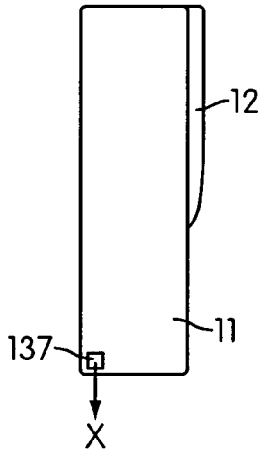
Figure 11:
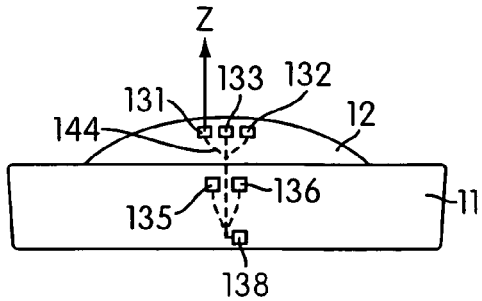

FIGS. 9–11 illustrate additional locations for the sensors 13. A sensor 137 is positioned in the lower front portion of the mouth guard 11. The sensor 137 is positioned to measure forces in the x-direction. An additional sensor 138 is provided in the lower front portion of the mouth guard 11 to measure forces in the y-direction. As shown in FIG. 11, sensor 138 is spaced from sensor 136. A sensor 139 is provided in the rear portion of the mouth guard 11. As shown in FIG. 9, the sensor 139 measures forces in a direction between the x and y-directions. The mouthpiece assembly illustrated in FIGS. 9–11 includes nine sensors. It is contemplated that additional sensors may be provided on opposing ends of the mouthpiece 11. The present invention is not intended to be limited to six sensors, shown in FIG. 8, or nine sensors, shown in FIGS. 9–11. Numerous combinations of sensors are possible. Fewer than six sensors may be provided.

Figure 3:
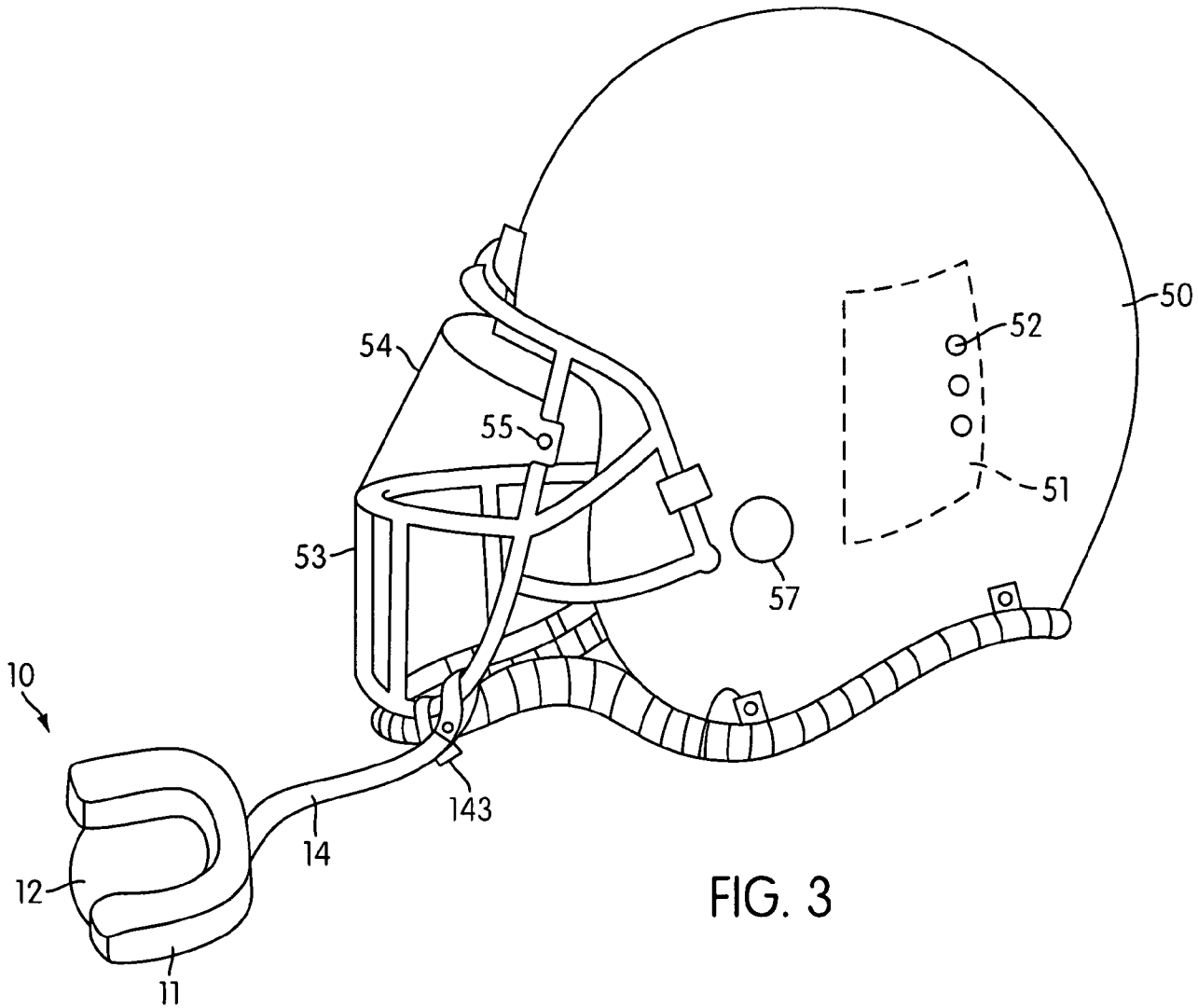
FIG. 3 is a schematic view of the mouthpiece of FIG. 1 secured to a protective helmet.

The mouthpiece assembly 10 includes a connector strap 14. The connector strap 14 extends from a lower front portion of the mouth guard 11. The connector strap 14 is configured to secure the mouthpiece assembly 10 to a protective helmet or headgear, as shown for example in FIG. 3. A free end of the connector strap 14 may include a snap fastener assembly 141. The free end of the connector strap 14 may form a loop 142 around a portion of the faceguard of the helmet to secure the mouthpiece assembly 10 to the helmet, as shown in FIG. 3. The snap fastener assembly 141 may be releasable so that the mouthpiece assembly 10 can be separated from the helmet. It is also contemplated that the fastener assembly 141 may be a grommet or other more permanent fastener. It is also contemplated that the fastener assembly 141 may directly attach the mouthpiece assembly 10 to the side of the helmet.

As shown in FIGS. 1–4, the connector strap 14 may include at least one indicator 143. The indicator 143 will operate when the at least one sensor 131, 132, 133, 134, 135, 136, 137, 138, 139 detects an impact that exceeds a threshold value. The indicator 143 is electrically connected to the sensors 13 through connection line 144. The indicator 143 provides either a visual indicator and/or an audible indicator to the athlete, the referees on the playing field and the coaching staff on the sideline that the athlete's head has experienced an impact that may require the athlete be removed from the game to seek medical attention. It is preferable that the sensors 13 be selected and/or programmable such that a different threshold value can be set based upon the individual athlete. The threshold can be determined and set based upon age, height, weight and past medical history. The indicator 143 may include a LED light, which illuminates when the threshold is exceeded. It is also contemplated that the indicator 143 include a digital display that provides in addition to a visual indication when a threshold has been exceeded but also a numerical value associated with the impact. The connector strap 14 also includes a battery pack 145, which provides sufficient energy to operate both the sensors 13 and the indicator 143. The battery pack 145 may include a single lithium battery or another suitable power source.

The mouthpiece assembly 10 may be used in connection with a helmet 50, shown in FIG. 3. The helmet 50 may have a construction similar to that disclosed in U.S. Pat. No. 5,539,935 and U.S. Pat. No. 5,621,922. The helmet 50 has a sensing and signaling module 51, which includes signaling lamps 52 arranged in any suitable pattern so as to be easily perceivable by someone observing a player wearing the helmet. It is also contemplated that the signaling module 51 may be linked to the indicator 143 on the connector strap 14. The helmet 50 also includes a face protector 53, a mask 54 secured by clips 55, as well as a chin strap 56 which secures the helmet 50 to the head of the user. Preferably the module 51 is located just to the rear of either the left or right ear hole 57 of the helmet 10 or in the rear of the helmet 10. This location makes signaling lamps 52 more visible to a referee or coach and also protects the module 51 from unnecessary impact during an athletic contest. The module 51 includes a suitable power source. The signaling module 51 may be connected to a jack or port 58 located on the rear of the helmet 50. When the signaling lamp 52 or indicator 143 signals an impact exceeding a threshold value, the player can be removed from the playing field. On the sidelines, the player's helmet can be removed. The helmet 50 can then be connected to a computer on the sideline through jack 58 to download information from the sensors in the helmet 50 and the mouthpiece assembly 10. The downloaded information relates to the magnitude ad location of impact forces on the head and neck.

Figure 5:
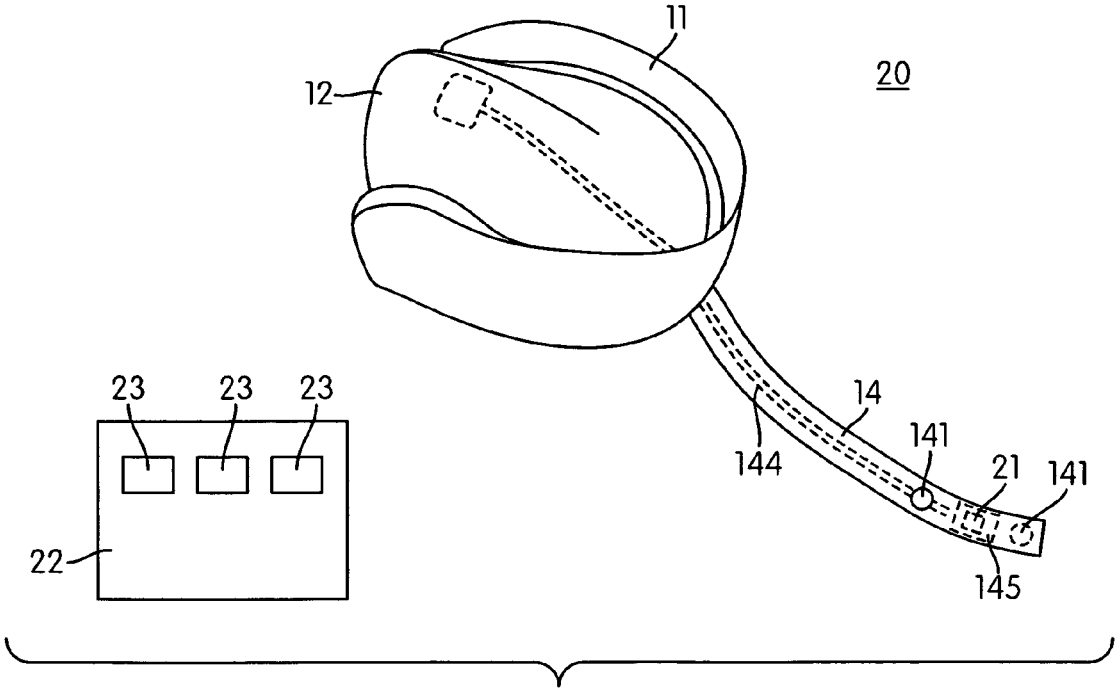
FIG. 5 is a right front side perspective view of a mouthpiece in accordance with another embodiment of the present invention having a transmitter for transmitter signals from the mouthpiece to a remote location.

A variation of the mouthpiece assembly 10 is illustrated in FIG. 5. The mouthpiece assembly 20 includes a transmitter 21. The transmitter 21 is positioned within the connector strap 14. While the transmitter 21 is shown to be located near an end of the connector strap 14, it is contemplated that the transmitter 21 may be located at any location along the strap 14. In order to improve the transmission qualities, it is preferable that the transmitter 21 be located on the strap 14 at a point that is located outside of the user's mouth. The transmitter 21 transmits signals from the sensors 13 to a remote location. In particular, the signals are transmitted to a remote receiver 22 that is located on the sideline of the playing field. The remote receiver 22 includes a controller that is capable of receiving and processing the signals from the sensors 13. When a predetermined threshold force is exceeded (i.e., a player has experienced a hit to the head and/or neck that may or could result in injury), an indicator 23 on the receiver 22 provides either a visual and/or audible indication to the coaching staff on the sideline of a potential injury so that the player can be removed from the game for medical attention. It is contemplated that a single remote receiver 22 can be provided to monitor multiple mouthpiece assemblies. A separate indicator 23 would be provided on the remote receiver 22 for each mouthpiece assembly. As such, all of the players on the field can be monitored from a central location in case of a potential neck and/or head injury.

The mouthpiece assembly 20 may be used in connection with the protective helmet 50. The helmet 50 may include a transmitter that also communicates with the remote receiver 22 such that the indicator 23 may be actuated in response to an excessive force being measured either by the sensors 13 in the mouthpiece assembly 20 or the sensing module 51 in the helmet 50. The sensing module 51 may include its own transmitter that transmits signals to the remote receiver 22. It is also contemplated that the sensing module 51 may be electrically connected to the transmitter 21 such that signals from the sensors 13 and the sensing module 51 are transmitted from a single transmitter. Additionally, information from the sensors 13 and the receiving module 51 can be downloaded through jack 58.

Figure 6:
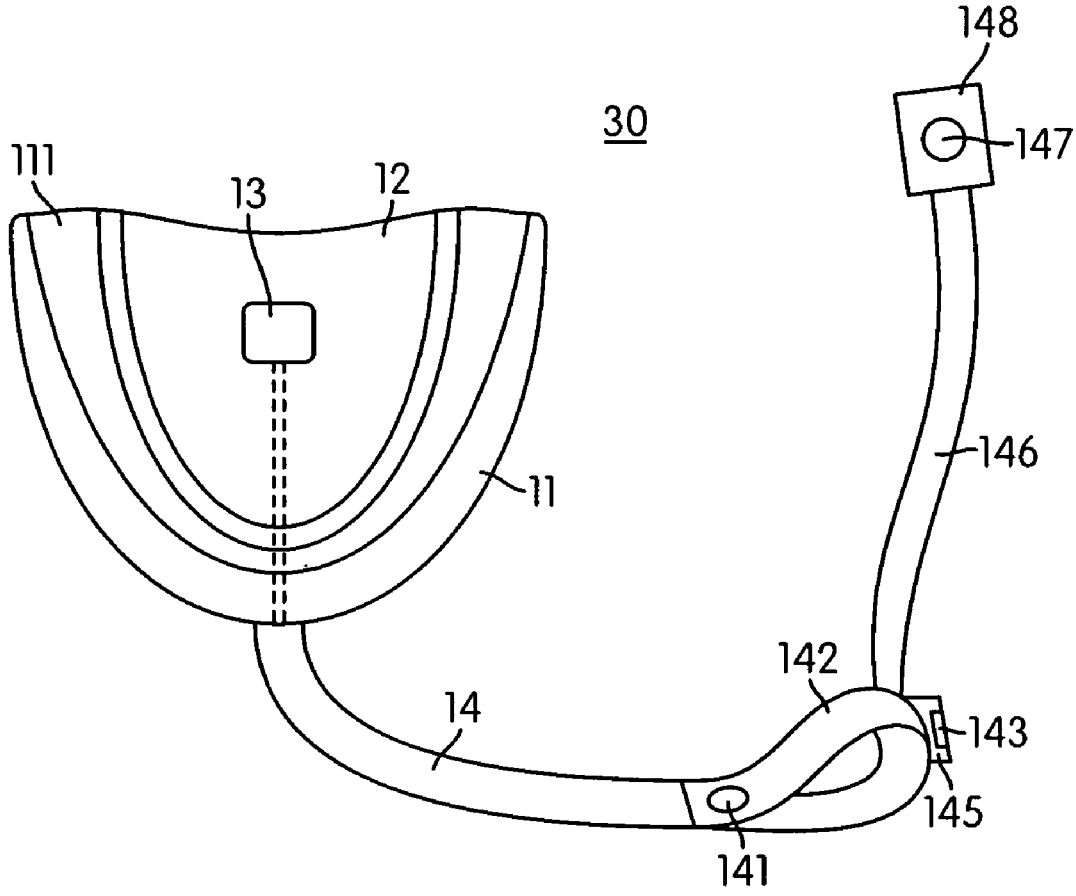
FIG. 6 is a top view of a mouthpiece in accordance with another embodiment of the present invention.
Figure 7:
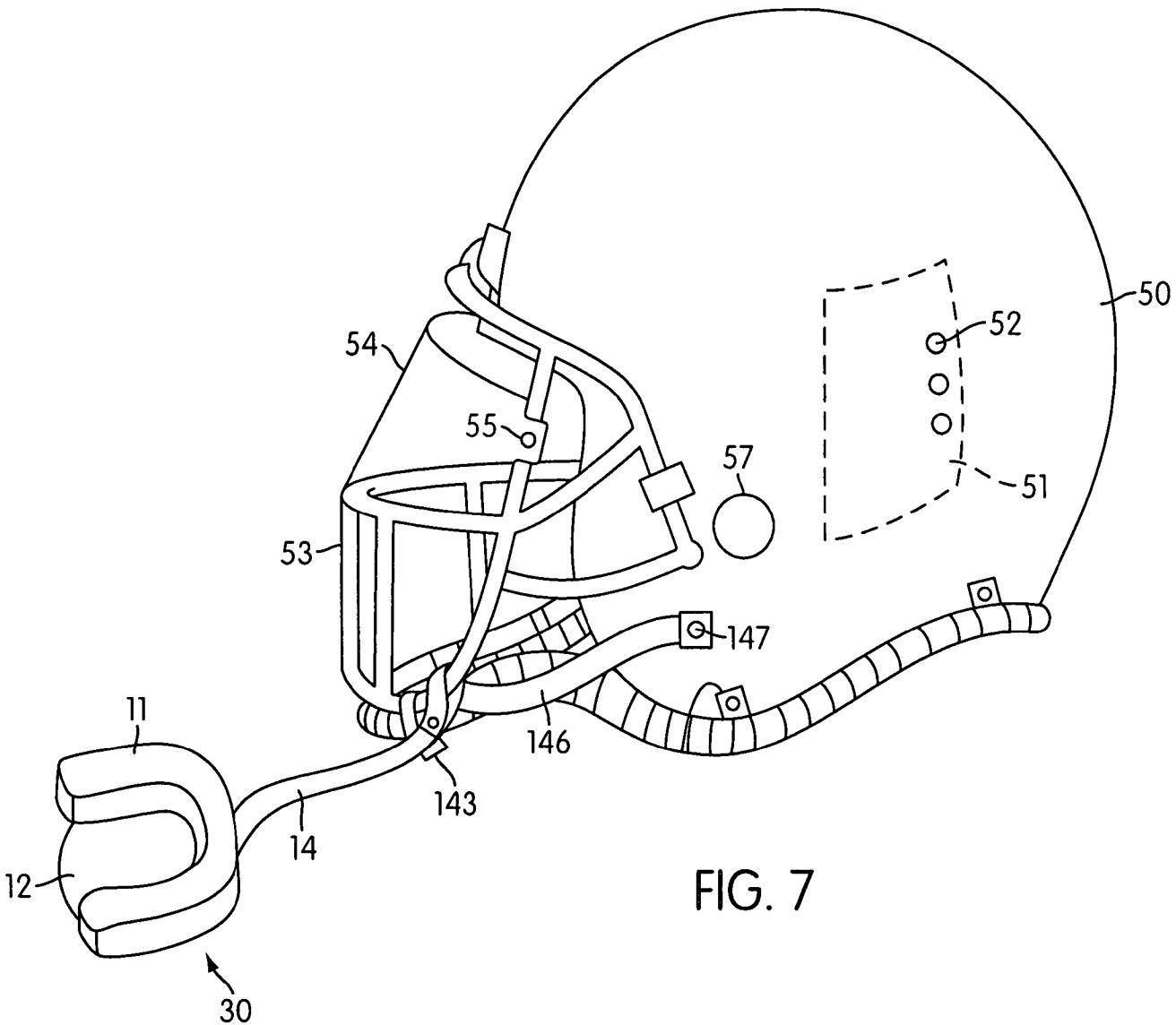
FIG. 7 is a schematic view of the mouthpiece of FIG. 6 secured to a protective helmet.

Another variation of the mouthpiece assembly 10 is illustrated in FIGS. 6 and 7. The mouthpiece assembly 30 includes a connector strap 14 having an extension strap 146. The extension strap 146 includes an indicator 147 located thereon. The indicator 147 is operatively connected to the sensors 13, the indicator 143 and the battery pack 145. The mouthpiece assembly 30 may include a battery pack 148, which can either replace or supplement battery pack 145. It is also contemplated that the indicator 143 can be omitted in lieu of the indicator 147. The extension strap 146 is sized such that the indicator 147 can be positioned on the side of the protective helmet such that the indicator 147 is visible to the coaching staff on the sidelines or officials on the field. The extension strap 146 can be secured to the helmet 50 using a suitable fastener. The fasteners may include a snap fastener that is secured to a complementary fastener on the helmet, hook and loop fasteners or a suitable adhesive.

While the invention has been described in connection with what is presently considered to be the most practical and preferred embodiments, it is to be understood that the invention is not to be limited to the disclosed embodiments and elements, but, to the contrary, is intended to cover various modifications, combinations of features, equivalent arrangements, and equivalent elements included within the spirit and scope of the appended claims. The use of numerous sensors are possible. While the preferred sensor is an accelerometer, it is contemplated that other sensors may be used provided the sensing device is compact. Furthermore, the dimensions of features of various components that may appear on the drawings are not meant to be limiting, and the size of the components therein can vary from the size that may be portrayed in the figures herein. Thus, it is intended that the present invention covers the modifications and variations of the invention, provided they come within the scope of the appended claims and their equivalents.

What is claimed is:

1. A sensing mouthpiece assembly for sensing impact forces on a head of a user, wherein the user has a mouth with a hard palate and a set of upper teeth having at least one molar located on each end of the set, the mouthpiece assembly comprising:

a mouth guard shaped to receive the set of the upper teeth therein, wherein the mouth guard includes a channel sized to receive the upper teeth therein, the channel being configured such that the mouth guard is releasably secured to the at least one molar;

a raised dome portion extending from the mouth guard, wherein the raised dome portion is shaped to conform to at least a portion of the hard palate of the mouth of the user;

at least one linear force sensor for measuring linear forces exerted on the head of the user during an impact event, wherein the least one linear force sensor is positioned in at least one of the mouth guard and raised dome portion;

at least one rotational force sensor for measuring rotational forces exerted on the head of the user during an impact event, wherein the least one rotational force sensor is positioned in at least one of the mouth guard and raised dome portion; and at least one indicator operatively connected to the at least one linear force sensor and the at least one rotational force sensor, wherein the at least one indicator provides an indication when at least one of the linear force sensor and the rotational force sensor detects a force greater than a predetermined value.

2. The sensing mouthpiece according to claim 1, wherein the mouth guard and the raised dome portion are formed from a rigid material.

3. The sensing mouthpiece according to claim 2, wherein the rigid material is a plastic material.

4. The sensing mouthpiece according to claim 2, further comprising:

a soft material located in the channel, wherein the set of upper teeth contact the soft material when the set of teeth are positioned in the channel.

5. The sensing mouthpiece according to claim 1, further comprising:

a connector strap extending from the mouth guard, wherein the connector strap is adapted to secure the mouthpiece to a protective helmet.

6. The sensing mouthpiece according to claim 5, wherein the at least one indicator is connected to the connector strap.

7. The sensing mouthpiece according to claim 5, wherein the at least one indicator comprising:

a first indicator positioned on the connector strap; and a second indicator connected to the connector strap, wherein the second indicator is adapted to be located on the protective helmet spaced from the first indicator.

8. The sensing mouthpiece according to claim 1, further comprising:

a transmitter for transmitting signals from the at least one rotational sensor and the at least one linear sensor to a remote receiver, wherein the at least one indicator is connected to the remote receiver, wherein the remote receive and the at least one indicator are remotely located from the mouthpiece, wherein the transmitter transmits signals from the rotational sensor and the linear sensor to the remote receiver to operate the indicator.

9. The sensing mouthpiece according to claim 1, wherein the at least one linear force sensor includes at least one accelerometer, wherein the accelerometer is positioned in at least one of the mouth guard and raised dome portion.

10. The sensing mouthpiece according to claim 1, wherein the at least one rotational force sensor includes at least one accelerometer, wherein the accelerometer is positioned in at least one of the mouth guard and raised dome portion.

11. A combination protective helmet and mouthpiece for sensing impact forces on a head of a user, wherein the user has a mouth with a hard palate and a set of upper teeth having at least one molar located on each end of the set, the combination comprising:

a protective helmet for covering for at least a portion of the head of the user; and a sensor mouthpiece assembly comprising:

a mouth guard shaped to receive the set of the upper teeth therein, wherein the mouth guard includes a channel sized to receive the upper teeth therein, the channel being configured such that the mouth guard is releasably secured to the at least one molar;

a raised dome portion extending from the mouth guard, wherein the raised dome portion is shaped to conform to at least a portion of the hard palate of the mouth of the user;

at least one linear force sensor for measuring linear forces exerted on the head of the user during an impact event, wherein the least one linear force sensor is positioned in at least one of the mouth guard and raised dome portion;

at least one rotational force sensor for measuring rotational forces exerted on the head of the user during an impact event, wherein the least one rotational force sensor is positioned in at least one of the mouth guard and raised dome portion; and at least one indicator operatively connected to the at least one linear force sensor and the at least one rotational force sensor, wherein the at least one indicator provides an indication when at least one of the linear force sensor and the rotational force sensor detects a force greater than a predetermined value.

12. The combination according to claim 11, wherein the mouth guard and the raised dome portion of the mouthpiece are formed from a rigid material.

13. The combination according to claim 12, wherein the rigid material is a plastic material.

14. The combination according to claim 12, wherein a soft material is located in the channel, wherein the set of upper teeth contact the soft material when the set of teeth are positioned in the channel.

15. The combination according to claim 11, further comprising:

a connector strap extending from the mouth guard, wherein the connector strap is adapted to secure the mouthpiece to the protective helmet.

16. The combination according to claim 15, wherein the at least one indicator is connected to the connector strap.

17. The combination according to claim 15, wherein the at least one indicator comprising:

a first indicator positioned on the connector strap; and a second indicator connected to the connector strap, wherein the second indicator is adapted to be located on the protective helmet spaced from the first indicator.

18. The combination according to claim 11, further comprising:

a transmitter for transmitting signals from the at least one rotational sensor and the at least one linear sensor to a remote receiver, wherein the at least one indicator is connected to the remote receiver, wherein the remote receive and the at least one indicator are remotely located from the mouthpiece, wherein the transmitter transmits signals from the rotational sensor and the linear sensor to the remote receiver to operate the indicator.

19. The combination according to claim 11, wherein the at least one linear force sensor includes at least one accelerometer, wherein the accelerometer is positioned in at least one of the mouth guard and raised dome portion.

20. The combination according to claim 11, wherein the at least one rotational force sensor includes at least one accelerometer, wherein the accelerometer is positioned in at least one of the mouth guard and raised dome portion.

21. The combination according to claim 11, wherein the protective helmet comprising:

at least one sensor for detecting selected motion of the head of the user wearing the protective helmet.

22. The combination according to claim 21, wherein the at least one sensor is operatively connected to the at least one indicator, wherein the at least one indicator provides an indication when the at least one sensor detects a force greater than a predetermined value.

23. The combination according to claim 22, further comprising:

a connector strap extending from the mouth guard, wherein the connector strap is adapted to secure the mouthpiece to the protective helmet.

24. The combination according to claim 23, wherein the at least one indicator is connected to the connector strap.

25. The combination according to claim 23, wherein the at least one indicator comprising:

a first indicator positioned on the connector strap; and a second indicator connected to the connector strap, wherein the second indicator is adapted to be located on the protective helmet spaced from the first indicator.

26. The combination according to claim 22, further comprising:

a transmitter for transmitting signals from the at least one sensor, the at least one rotational sensor and the at least one linear sensor to a remote receiver, wherein the at least one indicator is connected to the remote receiver, wherein the remote receive and the at least one indicator are remotely located from the mouthpiece, wherein the transmitter transmits signals from sensor, the rotational sensor and the linear sensor to the remote receiver to operate the indicator.

* * * * *